US009016166B2

(12) United States Patent
Min et al.

(10) Patent No.: US 9,016,166 B2
(45) Date of Patent: Apr. 28, 2015

(54) PEDAL APPARATUS FOR VEHICLE

(71) Applicants: Hyundai Motor Company, Seoul (KR); Kia Motors Corporation, Seoul (KR)

(72) Inventors: Jeong Seon Min, Gwangju (KR); Yang Rae Cho, Gyeonggi-do (KR); Jee Hyuck Choi, Gyeonggi-do (KR); Eun Sik Kim, Gyeonggi-do (KR); Ho Jin Choi, Gyeongsangnam-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 13/936,489

(22) Filed: Jul. 8, 2013

(65) Prior Publication Data

US 2014/0305255 A1 Oct. 16, 2014

(30) Foreign Application Priority Data

Apr. 16, 2013 (KR) ..... 10-2013-0041355

(51) Int. Cl.

| | |
|---|---|
| ***G05G 1/30*** | (2008.04) |
| ***G05G 5/06*** | (2006.01) |
| ***G05G 1/44*** | (2008.04) |
| ***G05G 5/03*** | (2008.04) |
| *G05G 5/00* | (2006.01) |

(52) U.S. Cl.

CPC .. *G05G 1/44* (2013.01); *G05G 5/03* (2013.01); *G05G 5/005* (2013.01)

(58) Field of Classification Search

CPC ..... G05G 1/30; G05G 1/405
USPC ..... 74/473.16, 473.3, 478, 512–514, 516, 74/539–542, 560; 188/357
IPC ..... G05G 1/30; B60K 26/02
See application file for complete search history.

(56) References Cited

U.S. PATENT DOCUMENTS

| | | | | |
|---|---|---|---|---|
| 4,497,395 | A * | 2/1985 | Nogami et al. | 477/93 |
| 7,051,614 | B2 * | 5/2006 | Podkopayev | 74/512 |
| 7,478,575 | B2 * | 1/2009 | Revelis | 74/473.16 |

FOREIGN PATENT DOCUMENTS

| | | | |
|---|---|---|---|
| JP | 2002-211264 | A | 7/2002 |
| KR | 20-1999-0023872 | U | 7/1999 |
| KR | 10-0410478 | B1 | 12/2003 |

(Continued)

OTHER PUBLICATIONS

Notice of Allowance mailed Apr. 1, 2014, issued for Korean patent Application No. 10-2013-0041355.

*Primary Examiner* — Thomas Diaz
*Assistant Examiner* — Adam D Rogers
(74) *Attorney, Agent, or Firm* — Mintz Levin Cohn Ferris Glovsky and Popeo, P.C.; Peter F. Corless

(57) ABSTRACT

A pedal apparatus for a vehicle includes: a pedal arm mounted on a vehicle body by a hinge shaft and having one end connected with a pedal and the other end where a rack gear is formed; a link arm having a pinion gear at one end that meshes with the rack gear to pivot on a center shaft of the pinion gear with respect to the pedal arm, and having the other end where a locking pin is formed; and a plate mounted on the vehicle body, the plate having a sliding groove where the locking pin of the link arm is inserted, in which ridges and depressions are formed at regular intervals in the sliding groove so that the locking pin slides step by step while being locked to the ridges and depressions.

10 Claims, 6 Drawing Sheets

(56) References Cited

FOREIGN PATENT DOCUMENTS

| | | | |
|---|---|---|---|
| KR | 10-1996-0700146 | | 3/2004 |
| KR | 10-0527744 | B1 | 11/2005 |
| KR | 10-0614525 | B1 | 8/2006 |
| KR | 10-2009-0098310 | A | 9/2009 |
| KR | 10-2012-0099326 | A | 9/2012 |

* cited by examiner

PEDAL APPARATUS FOR VEHICLE

CROSS-REFERENCE TO RELATED APPLICATION

This application claims under 35 U.S.C. §119(a) the benefit of Korean Patent Application No. 10-2013-0041355 filed Apr. 16, 2013, the entire contents of which are incorporated herein by reference.

BACKGROUND (a) Technical Field

The present invention relates to a pedal apparatus for a vehicle, and more particularly, to an apparatus for preventing disoperation of a pedal, relating to a clutch, a brake, and an acceleration pedal.

(b) Description of the Related Art

Various pedals that a driver operates with the feet are mounted in vehicles in which the acceleration pedal and the brake pedal are next to each other and similar in operation method and operation feel, and thus they have a structure with a high possibility of disoperation. For example, the driver may press down the accelerator pedal by mistake when intending to press down the brake pedal in an emergency.

In order to preclude such an accident, KR 10-1996-0700146 discloses an apparatus for preventing disoperation of an accelerator in a vehicle, in which a separable coupling member using a permanent magnet and a suction plate is disposed at the joint of an accelerator pedal and a throttle cable so that when the rotational angular velocity of the pedal exceeds a predetermined level, the suction plate attached to the permanent magnet by magnetic force separates from the permanent magnet and disconnects the pedal from the throttle cable.

Accordingly, in a conventional accelerator pedal, parts such as a pedal operation status sensor, which senses the operation status of an accelerator pedal, an ECU connected to the sensor, and a solenoid valve operating a vacuum/atmosphere valve in a booster in connection with the ECU are required, and accordingly, there is a problem in that the structure is complicated, in particular, due to the large number of necessary parts, which results in a higher manufacturing cost.

Therefore, it is desirable to develop a pedal apparatus for a vehicle which can effectively prevent disoperation of a pedal, with a simple structure, even though a driver is unaware of the disoperation.

The description provided above as a related art of the present invention is just for helping understanding the background of the present invention and should not be construed as being included in the related art known by those skilled in the art.

SUMMARY OF THE DISCLOSURE

The present invention has been made in an effort to solve problems of the related art, and an object of the present invention is to provide a pedal apparatus for a vehicle which can effectively prevent disoperation of a pedal, with a simple structure, even though a driver is unaware of the disoperation.

A pedal apparatus for a vehicle includes: a pedal arm mounted on a vehicle body by a hinge shaft and having a first end connected with a pedal and a second end (i.e., an end that is opposite to the first end) where a rack gear is formed, with respect to the hinge shaft; a link arm having a pinion gear at one end which meshes with the rack gear to pivot on a center shaft of the pinion gear during pivoting of the pedal arm, and having another end where a locking pin is formed; and a plate mounted on the vehicle body, the plate being formed with a sliding groove such that the locking pin of the link arm is inserted and slides in the sliding groove, where ridges and depressions are formed at regular intervals in the sliding groove so that the locking pin slides in a step-by-step manner while being locked to the ridges and depressions.

The pedal arm may have an extension link extending upward above the hinge shaft, and the rack gear may be formed at the end of the extension link. The rack gear at the end of the extension link may be formed with teeth faced downwardly.

A guide slot having a predetermined length may be formed at a predetermined position between the rack gear of the pedal arm and the hinge shaft, and the center shaft of the pinion gear may be fixed to the vehicle body through the guide slot. In particular, the guide slot having the predetermined length may be formed through the extension link in parallel with the teeth of the rack gear, at a predetermined position under the rack gear, and the pinion gear may mesh with the rack gear, with the center shaft fixed to the vehicle body through the guide slot under the rack gear.

The pinion gear may be fixed to one end of the link arm, the center shaft of the pinion gear is fixed to the vehicle body, and thus as the pinion gear rotates, the link arm may rotate.

The plate may be disposed at a predetermined position under the rack gear, and the link arm may have one end disposed up so that the pinion gear engages with the rack gear and the other end disposed down so that the locking pin is inserted in the sliding groove. The sliding groove of the plate may be formed in an arc shape, coaxially about the center shaft of the pinion gear. The sliding groove of the plate may be longer than the length of the rack gear. The ridges and depressions of the sliding groove may be formed by a plurality of continuous grooves, and the locking pin of the link arm may be inserted into and locked in the locking grooves.

BRIEF DESCRIPTION OF THE DRAWINGS

The above and other features of the present invention will now be described in detail with reference to certain exemplary embodiments thereof illustrated the accompanying drawings which are given herein below by way of illustration only, and thus are not limitative of the present invention, and wherein.

Figure 1:
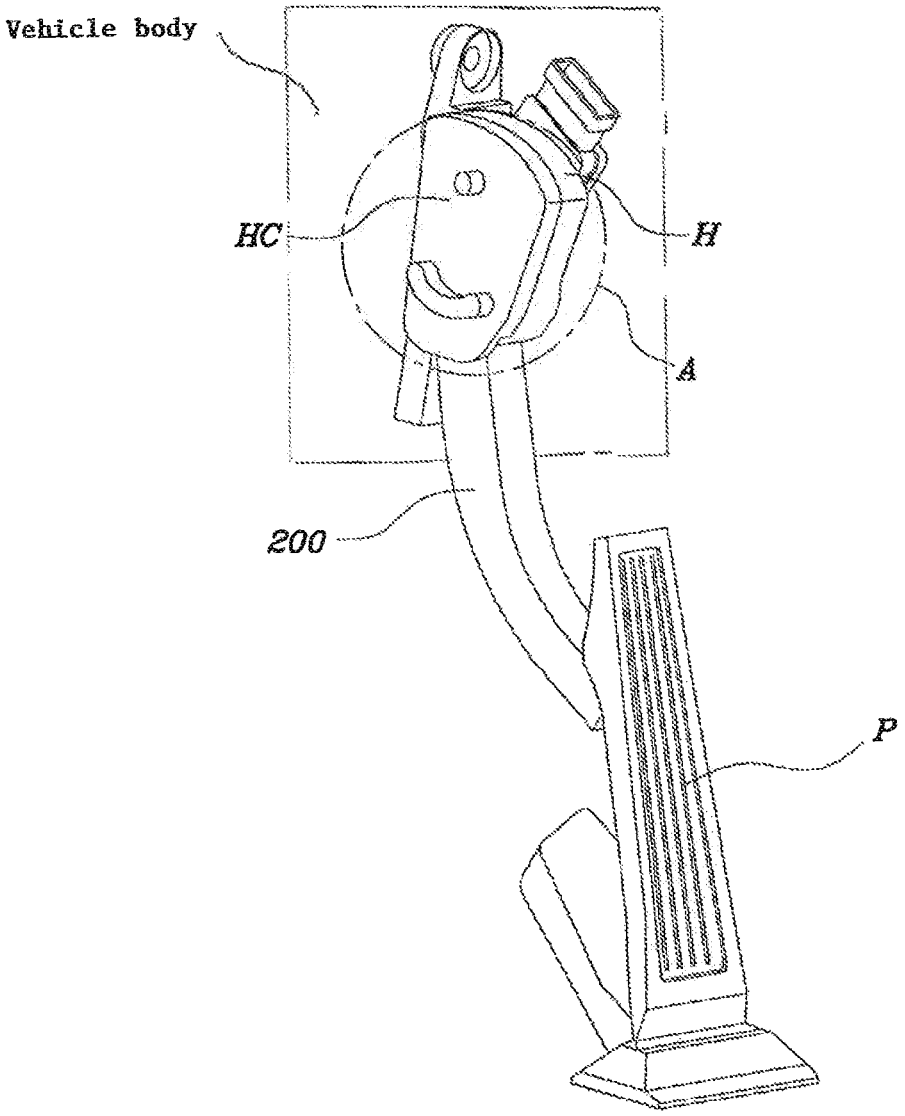
FIG. 1 is a front perspective view of a pedal apparatus for a vehicle according to an embodiment of the present invention, the pedal apparatus being mounted on a pedal.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

A pedal apparatus for a vehicle according to the present invention is described hereafter with reference to the accompanying drawings.

Figure 2:
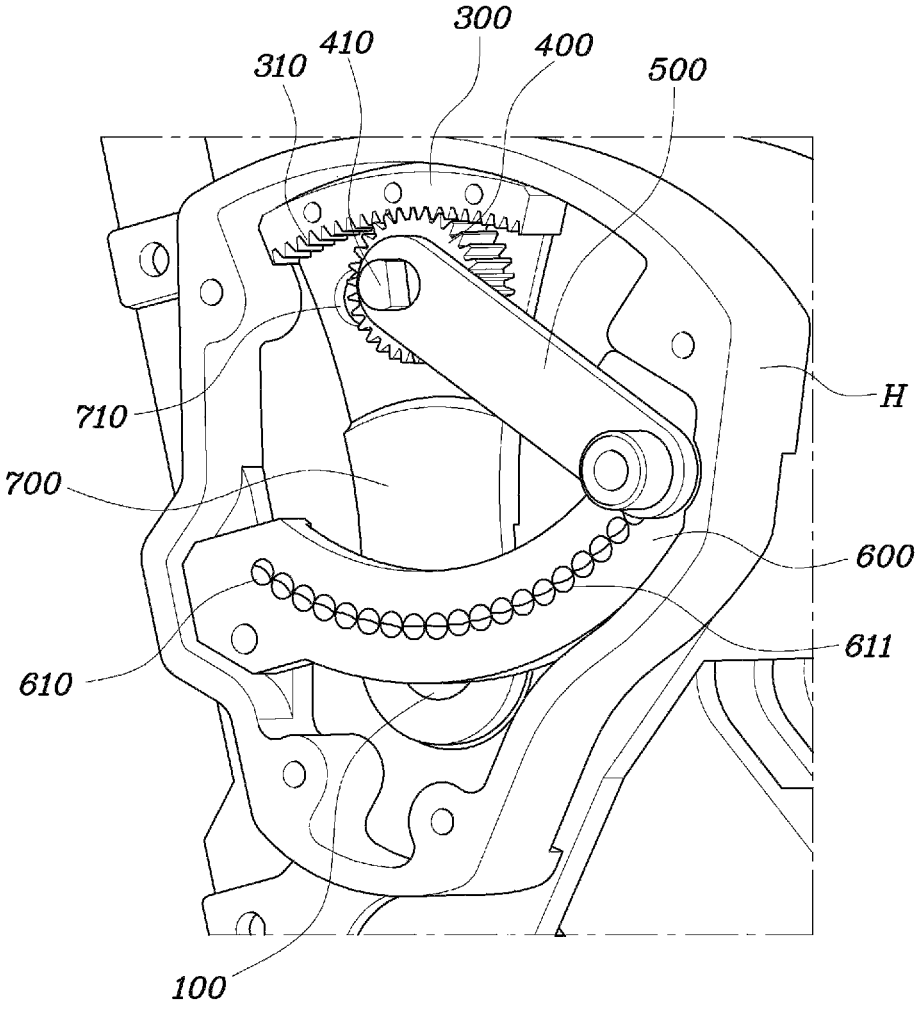
FIG. 2 is an enlarged detailed view of a portion A depicted in FIG. 1, in which a housing cover in FIG. 1 is removed.
Figure 3:
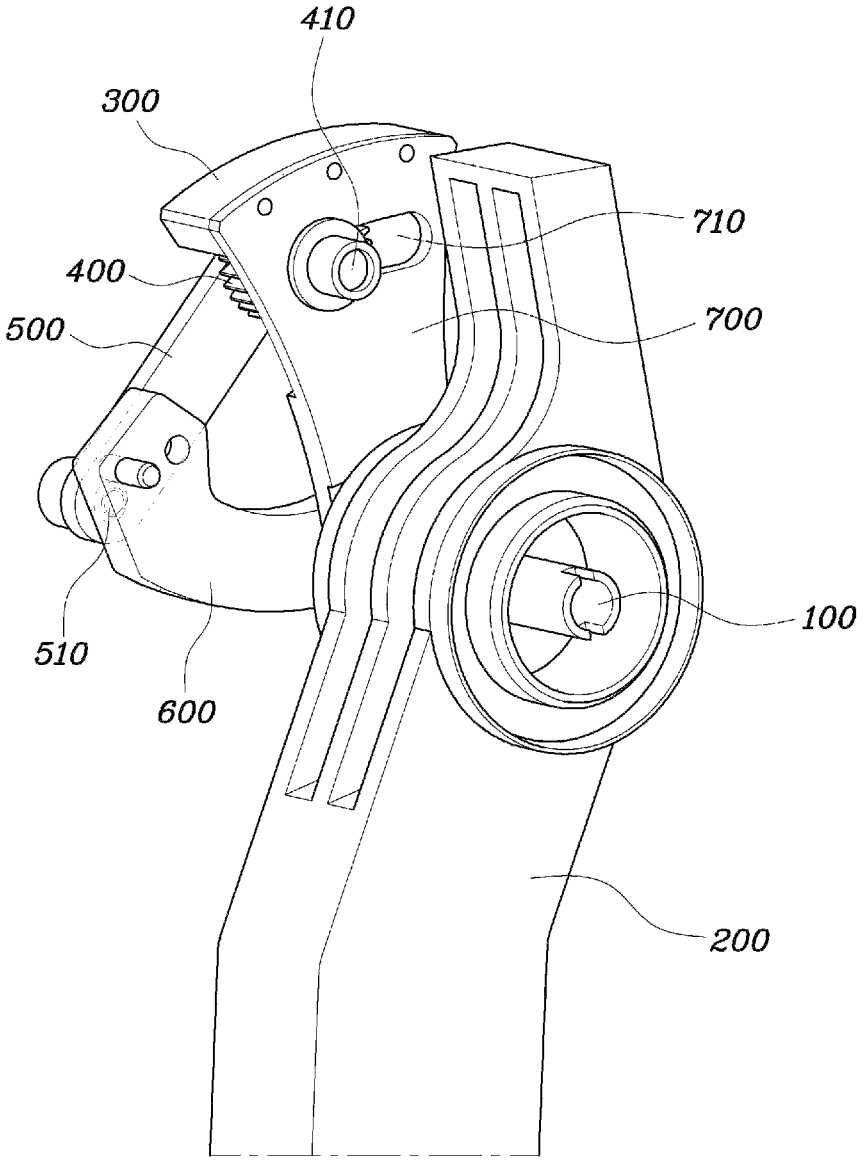
FIG. 3 is a rear perspective view of the pedal apparatus of FIG. 1.

FIG. 1 is a front perspective view showing when a pedal apparatus P for a vehicle according to an embodiment of the present invention, where the pedal apparatus P is mounted on a pedal. FIG. 2 is an enlarged perspective view showing a portion A of FIG. 1, except a housing cover HC in FIG. 1. Further, FIG. 3 is a rear perspective view showing the rear side of the pedal apparatus vehicle according to the present invention. The pedal apparatus for a vehicle according to an exemplary embodiment of the present invention includes: a pedal arm 200 mounted on a vehicle body (e.g., a car body) by a hinge shaft 100 and having a first end connected with the pedal P and a second end where a rack gear 300 is formed, with respect to the hinge shaft 100; a link arm 500 having a pinion gear 400 at one end which meshes with the rack gear 300 to pivot on a center shaft 410 of the pinion gear 400 with pivot of the pedal arm 200, and having another end (i.e., the end opposite to the "one end") where a locking pin 510 is formed; and a plate 600 mounted on the vehicle body, having a sliding groove 610 where the locking pin 510 of the link arm 500 is inserted and slides, in which ridges and depressions are formed at regular intervals in the sliding groove 610 so that the locking pin 510 slides in a step-by-step manner while being locked to the ridges and depressions.

As shown in FIG. 1, the pedal apparatus for a vehicle according to an exemplary embodiment of the present invention is mounted on the top of the pedal arm 200. In other embodiments, the pedal apparatus may be mounted in a different manner so as to be varied in position or design type, and the configuration of accessories such as a housing H and a housing cover HC may also be modified, where a design of the vehicle may be optimized based on available space. Therefore, the arrangement of the various components is not fixed and may be freely varied without changing the essence of the present invention, depending on circumstances.

Although the pedal apparatus for a vehicle according to the present invention can be directly mounted on the vehicle body without the housing H or the housing cover HC, since the pedal P is a part that a driver of the vehicle operates with a foot and is disposed at the lowermost side in the vehicle, foreign substances such as soil and dust may flow or collect between the various parts. Since machinery is vulnerable to contamination, it is preferable to include the housing H and the housing cover HC, in order to protect the parts of the pedal apparatus, and thus the housing H and the housing cover HC are shown in FIG. 1 and are not specifically described in the explanation relating to FIGS. 2 to 5.

For the housing cover HC shown in FIG. 1, the position of the center shaft 410 of the pinion gear 400 and the rotation portion at the other end of the link arm 500 protrude outward, so that the center shaft 410 and the link arm 500 are held in position so as not to protrude out of the pivot position.

FIG. 2 is a view showing a portion A of FIG. 1 in detail, in which the housing cover HC has been omitted for convenience. The pedal arm 200 is mounted on the vehicle (e.g., car body) by a hinge shaft 100 and has a first end where the pedal P is connected and a second (or opposite) end where the rack gear 300 is formed, with respect to the hinge shaft 100, so that as a driver operates the pedal P, the pedal arm 200 revolves the rack gear 300 by transmitting a force transmitted by the driver's foot intended to operate the pedal P to the rack gear 300 through the hinge shaft 100.

The pedal arm 200 has an extension link 700 extending upward above the hinge shaft 100. The extension link 700 is an arc panel configured to rotate about the hinge shaft 100, and the rack gear 300 is formed at the end of the extension link 700. The shape of the extension link 700 may be varied, and the rack gear 300 may be manufactured as a separate part and then assembled or may be formed as an integral part, but it is exemplified as an integral part in the present embodiment.

Further, the rack gear 300 at the end of the extension link 700 is formed with the teeth 310 faced downwardly and meshes with the pinion gear 400 under the rack gear 300. The teeth 310 of the rack gear 300 may be formed to face upwardly, but when the teeth 310 of the rack gear 300 face upwardly, the pinion gear 400 that engages with the rack gear 300 is positioned further in an upward direction, the structure of the pedal apparatus for a vehicle of the present invention become larger, and there may be a limit in space for design; therefore, the teeth 310 of the rack gear 300 are arranged to face downwardly as shown in FIG. 2.

The rack gear 300 may be integrally formed at the top in the housing H so that only the extension link 700 pivots and engages with the pinion gear 400, as the pedal P operates. However, as shown in FIG. 2, the rack gear 300 is formed separately from the housing H, combined with the extension link 700, and revolved with the extension link 700, as the pedal P operates.

In the present invention, the extension link 700 rotates about the hinge shaft 100 with the operation of the pedal P, and it may be considered that the rack gear 300 makes a substantially straight motion, because the amount of rotation is not large. The pinion gear 400 engages with the rack gear 300 in order to convert an amount of movement due to operation of the pedal P into a rotational motion, and the pinion gear 400 is fixed to the vehicle body by the center shaft 410.

The center shaft 410 preferably is formed in a cylindrical shape, the portion fitted in the pinion gear 400 is formed flat by cutting a portion of a side of the cylinder, and the center of the pinion gear 400 may also be partially recessed inward to fit the flat side of the center shaft 410 in line with the shaft. The center shaft 410 is formed so as to combine the pinion gear 400 and the center shaft 410 in a firm manner and to implement accurate rotation by preventing sliding when the pinion gear 400 meshes during rotation with the rack gear 300.

The link arm 500 is fitted, coaxially with the pinion gear 400, on the center shaft 410 of the pinion gear 400. In particular, for the link arm 500, the pinion gear 400 engaging with the rack gear 300 is disposed at one end of the link arm 500, and the locking pin 510 is disposed at the other end. As a driver operates the pedal P and the pedal arm 200 pivots, the link arm 500 rotates about the center shaft 410 of the pinion gear 400, and the locking pin 510 at the other end of the link arm 500 revolves along the sliding groove 610 of the plate 600.

Therefore, as the pedal arm P operates, the extension link 700 rotates, the pinion gear 400 engaging with the rack gear 300 on the extension link 700 rotates, and the link arm 500 with one end fixed to the pinion gear 400 rotates about the center shaft 410 of the pinion gear 400, which is fixed to the vehicle body.

In more detail, the plate 600 is disposed at a predetermined distance under the rack gear 300, one end of the link arm 500 is disposed up, the pinion gear 400 meshes with the rack gear 300, the other end of the link arm 500 is disposed down, the link arm 500 is fixed to the pinion gear 400 and rotated, and accordingly, the locking pin 510 of the link arm 500 is put into/out of the sliding groove 610. The plate 600 is disposed on the vehicle body and has the sliding groove 610 in which the locking pin 510 of the link arm 500 is inserted, such that the locking pin 510 slides in the sliding groove 610. Further, locking grooves 611 with ridges and depressions are formed at regular intervals in the sliding groove 610 such that the locking pin 510 is put into/out of the sliding groove 610 in a step-by-step manner, and the locking pin 510 is locked to the locking grooves 611 while sliding; therefore, the sliding groove 610 of the plate 600 is formed coaxially about the center shaft 410 of the pinion gear 400 in an arc shape with the length of the link arm 500 as the radius.

The ridges and depressions of the sliding groove 610 are formed by the continuous locking grooves 611, and thus the locking pin 510 of the link arm 500 are put into/out of the locking grooves 611. Each locking groove 611 of the sliding groove 610 may be recessed, so as to form a groove, on the surface of the plate 600 or may be formed through the plate 600.

The pedal apparatus according to the present invention transmits operation force by converting the short rotational motion close to a straight motion of the extension link 700 due to the operation of the pedal P, using the rack gear 300 and the pinion gear 400, into the rotational motion of the link arm 500 disposed under the rack gear 300, thereby generating a lever ratio due to the distance between the pedal arm 200 and the hinge shaft 100 and the length of the link arm 500.

Even if the amount of force imparted to the pedal P is small, when the length of the link arm 500 is set such that the link arm 500 rotates at a large angle, the link arm 500 moves across a large number of locking grooves 611 of the plate 600 and the irregularity of the ridges and depressions is transmitted, and thus the driver can clearly recognize the operation of the pedal P, even though the driver operates the pedal P by a small amount. Therefore, the length of the link arm 500 can be designed to be variable in accordance with a necessary lever ratio, but it should be designed in consideration of the available space.

Further, since the lever ratio that allows the link arm 500 to rotate at a large angle even when a small amount of operation of the pedal P is applied, as described above, the length of the sliding groove 610 of the plate 600 is set to be larger than the length of the rack gear 300.

As described above, as the driver operates the pedal P, the driver can feel the irregularity of the ridges and depressions by the locking pin 510 of the link arm 500 which is locked to the locking grooves 611 of the sliding groove 610 of the plate while moving, and accordingly, the driver can recognize which pedal P is now operated. In particular, when the pedal P is pressed down and the locking pin 510 is inserted into and locked in a locking groove 611, the pedal P should be pressed down by a larger pedal effort than the previous time so that the locking pin 510 can move over the locking groove 611 to move to the next locking groove 611, and therefore the driver recognizes the operation status of the pedal P more clearly.

When the pedal apparatus for a vehicle according to the present invention is applied to one of an accelerator pedal and a brake pedal, a driver can immediately recognize that the driver operated a pedal by mistake from the irregularity of the ridges and depressions when pressing down an accelerator pedal, even though the driver should have pressed down the brake pedal in an emergency, for example, while driving on a road, and thus the driver can quickly take measures for immediately correcting the disoperation of the pedal and preventing the occurrence of an accident.

Similarly, since the locking grooves 611 may be formed at regular intervals or different intervals in accordance with particular design and the pedal can be operated in a step-by-step manner, when the apparatus is applied to a clutch pedal, a driver can easily recognize how much the clutch pedal is operated; therefore it is possible to preclude an engine from stopping due to excessive operation of the clutch pedal. Further, when the apparatus is applied to an accelerator pedal or a brake pedal, it is possible to operate the pedal in a step-by-step manner as necessary, depending on the situation, and it is not needed to press down the pedal more than the necessary amount, and thus there is the advantage that driving is easy and convenient in comparison to conventional arrangements.

The structure of generating the irregularity of the ridges and depressions serves to prevent hysteresis of a transmission, and the parts used in the related art to prevent hysteresis can be removed, and therefore the number of parts can be reduced and the manufacturing cost decreases.

Though not shown in the figures, as another embodiment of the present invention, the effect of the lever ratio may be used for the gear ratio based on the size of gears or the number of teeth of the gears, and it is possible to achieve the same effect as the lever ratio from a gear ratio by forming a gear on the hinge shaft 100 and forming an external gear, which is larger (has more teeth) than the gear formed on the hinge shaft 100, on the center shaft 410.

A guide slot 710 having a predetermined length is formed at a predetermined position between the rack gear 300 of the pedal arm 200 and the hinge shaft 100, and the center shaft 410 of the pinion gear 400 is fixed to the vehicle body through the guide slot 710. In more detail, the guide slot 710 having a predetermined length is formed through the extension link 700 in parallel with the teeth 310 of the rack gear 300, at a predetermined position under the rack gear 300, and the pinion gear 400 meshes with the rack gear 300, with the center shaft 410 fixed to the vehicle body through the guide slot 710 under the rack gear 300.

Accordingly, as the extension link 700 is rotated by the operation of the pedal arm 200, the guide slot 710 guides the center shaft 410 and the extension link 700 is actually operated, because the center shaft 410 of the pinion gear 400 is fixed to the vehicle body.

Since the teeth 310 of the rack gear 300 and the guide slot 710 are a portion of concentric circle around the hinge shaft 100, the teeth 310 of the rack gear 300 and the guide slot 710 are in parallel with each other, and the rack gear 300 and the pinion gear 400 can rotate around the hinge shaft 100 by meshing with each other.

Figure 4:
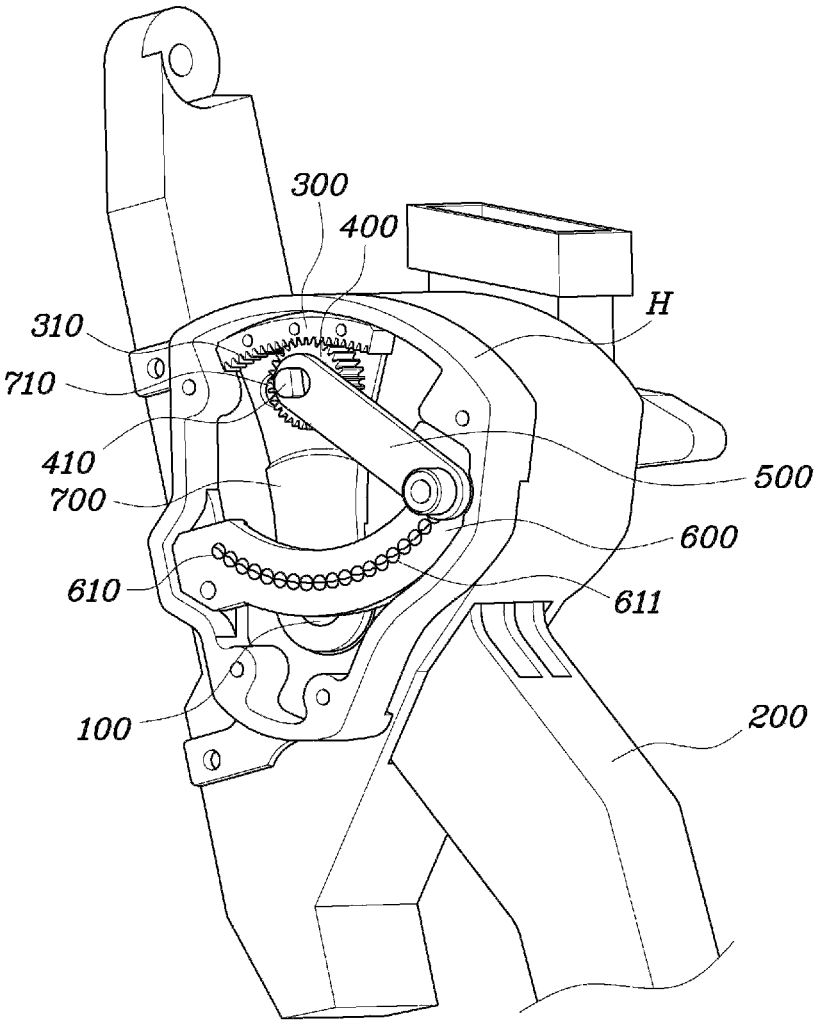
FIG. 4 is a front perspective view showing the pedal apparatus of FIG. 1 before operating.
Figure 5:
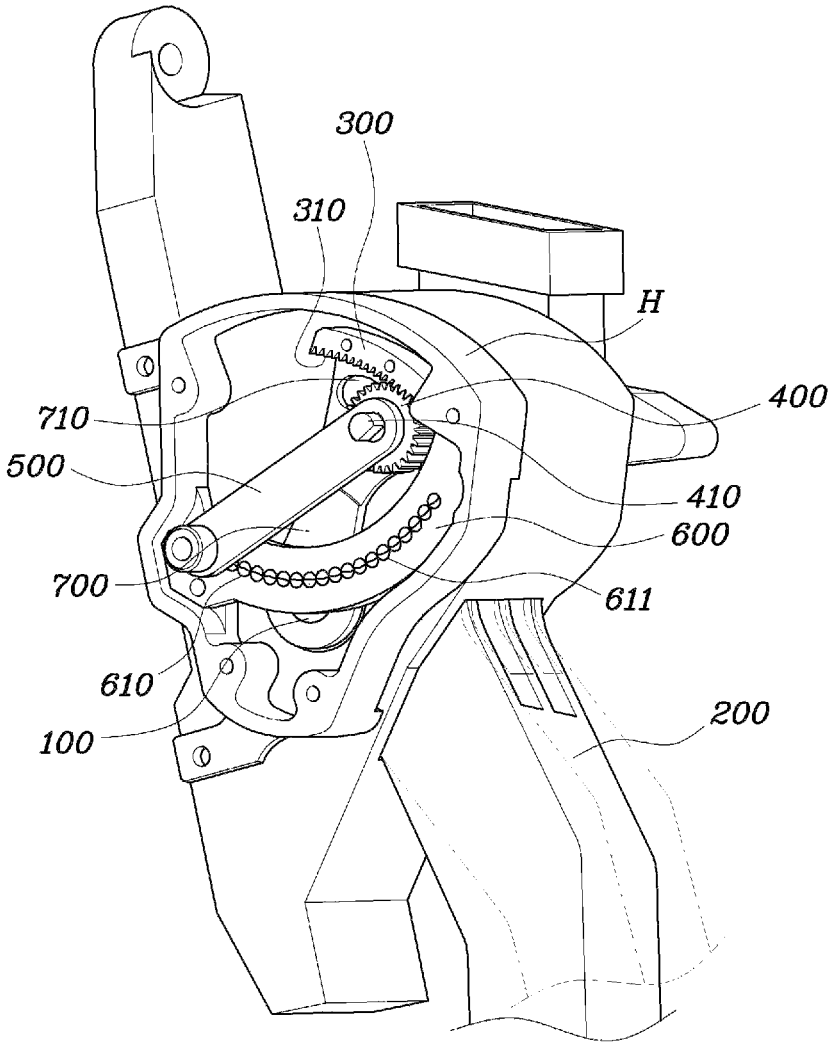
FIG. 5 is a front perspective view showing the pedal apparatus after an operation is carried out with respect to FIG. 4.

FIG. 4 is a view showing the pedal apparatus vehicle according to an embodiment of the present invention before operating, and FIG. 5 is a view showing the pedal apparatus after an operation is carried out with respect to FIG. 4. Referring to FIG. 4, it can be seen that the rack gear 300 and the link arm 500 are positioned in opposite directions, when a driver does not operate the pedal P. It can be seen from FIG. 5 that a driver has pressed down the pedal P, that is, as the driver presses down the pedal P, the extension link 700 formed at the upper end of the pedal arm 200 around the hinge shaft 100 rotates about the hinge shaft 100. Accordingly, the rack gear 300 at the end of the extension link 700 revolves, the pinion gear 400 rotates while meshing with the rack gear 300 by the revolution of the rack gear 300, the link arm 500 fitted on the center shaft 410 of the pinion gear 400 is rotated by the rotation of the pinion gear 400, and the locking pin 510 at the other end of the link arm 500 slides while being locked to the locking grooves 611 of the sliding groove 610 of the plate 600.

As the apparatus operates, as described above, a lever ratio is formed by the distance between the pedal P and the hinge shaft 100 and the length of the link arm 500, so that even though a driver operates the pedal a small amount, the link arm 500 rotates at a large angle, and the locking pin 510 of the link arm 500 moves a longer distance than the actual operation distance of the pedal while being repeatedly put into/out of the locking grooves 611 of the sliding groove 610, and the irregularity of the ridges and depressions is generated so that the driver can clearly recognize the operation; therefore, the driver recognizes that the corresponding pedal was operated and disoperation of a pedal is prevented.

Therefore, according to the pedal apparatus for a vehicle of the present invention, a driver can accurately recognize, without seeing, which pedal he/she operated and whether the pedal was operated in accordance with his/her intention, and the problem that a pedal is operated by mistake in an emergency can be precluded.

Further, since the locking pin 510 is locked to the locking grooves 611 in a step-by-step manner in accordance with the amount of operation of the pedal P, a driver can recognize in advance and operate a pedal as much as necessary, and thus the driver can accurately recognize how much he/she operated the pedal quantitatively.

Figure 6:
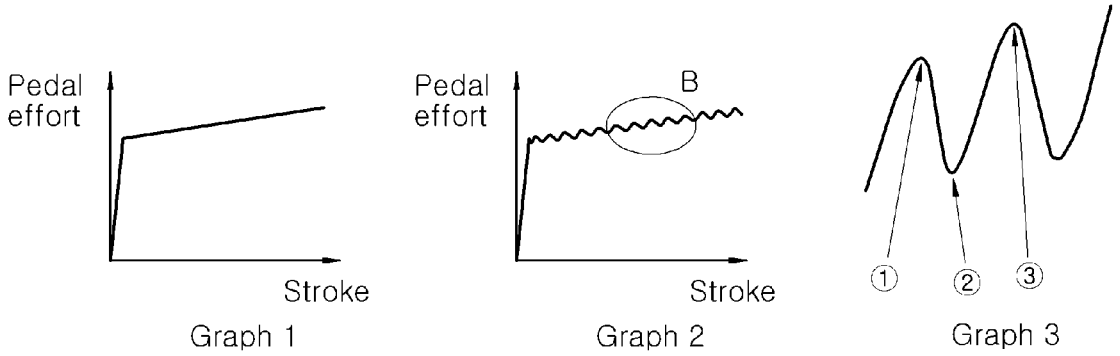
FIG. 6 shows graphs of the relationship between a pedal effort and a stroke of pedal apparatuses for a vehicle according to the related art and an embodiment of the present invention.

FIG. 6 numerically shows the amount of operation through graphs showing the effect described above, which are graphs showing the relationship between a necessary pedal effort and a stroke when the pedal apparatuses for a vehicle according to the related art and an embodiment of the present invention are mounted.

Graph 1 in FIG. 6 shows a necessary pedal effort when a common pedal of the related art was operated and from which it can be seen that the necessary pedal effort linearly increases so that a driver presses down and operates a pedal. Since it is equally applied to each pedal, a driver may operate a pedal by mistake in an emergency unless he/she carefully recognizes it.

Graph 2 in FIG. 6 is a graph showing a necessary pedal effort when a pedal P was pressed down with the pedal apparatus for a vehicle according to an embodiment of the present invention. Graph 3 shows the portion B of FIG. 2 in detail, and shows a necessary pedal effort when the locking grooves 611 of the sliding groove 610 were arranged at regular intervals.

As a drive operates the pedal P, the locking pin 510 of the link arm 500 slides while being locked to the locking grooves 611 of the sliding groove 610 of the plate 600, and since the locking pin 510 repeats coming out after being locked to the locking grooves 611, the graph showing the necessary pedal effort turns out increasing while repeatedly waving.

Referring to Graph 3 in FIG. 6, it can be seen that when it moves from the position 1 to the position 2 is the point of time where the locking pin 510 is locked to a locking groove 611 and the pedal effort is relatively small, and when it moves from the point 2 to the point 3 is the point of time where the locking pin 511 comes out of the locking groove 611 and the necessary pedal effort is relatively large. As the necessary pedal efforts are divided in this way, a driver can recognize which pedal is being operated, and thus disoperation of a pedal is prevented.

Although the present invention was described with reference to specific embodiments shown in the drawings, it is apparent to those skilled in the art that the present invention may be changed and modified in various ways without departing from the scope of the present invention, which is described in the following claims.

According to the pedal apparatus for a vehicle of the present invention having the structure described above, a driver can accurately recognize, without seeing, which pedal he/she operated and whether the pedal was operated in accordance with his/her intention, and should press down the pedal with a larger pedal effort than the previous time so that the locking pin can move over the locking groove to move to the next locking groove, when pressing down the pedal and the locking pin is inserted and locked in a locking groove; therefore, the driver recognizes the operation status of the pedal P more clearly and can recognize in advance and operate a pedal as much as necessary, and thus the drive can accurately recognize how much he/she operated the pedal quantitatively.

Therefore, when the pedal apparatus for a vehicle according to the present invention is applied to one of an accelerator pedal and a brake pedal, a driver can immediately recognize that the driver operated a pedal by mistake from the irregularity of the ridges and depressions when pressing down an accelerator pedal even though the driver should have pressed down the brake pedal in an emergency while driving on a road, and thus the driver can quickly take measures for immediately correcting the disoperation of the pedal and an accident.

In particular, since the locking grooves may be formed at regular intervals or different intervals as desired and the pedal can be operated in a step-by-step manner, when the apparatus is applied to a clutch pedal, a driver can easily recognize how much he/she operates the clutch pedal; therefore it is possible to preclude an engine from stopping due to excessive operation of the clutch pedal. Further, when the apparatus is applied to an accelerator pedal or a brake pedal, it is possible to operate the pedal in a step-by-step manner as much as necessary, depending on the situation, and it is not needed to press down the pedal over the necessary amount, and thus there is the advantage that driving is easy and convenient in comparison to the related art.

The structure of generating the irregularity of the ridges and depressions serves to prevent hysteresis of a transmission, and the parts used in the related to prevent hysteresis art can be removed, and therefore the number of parts can be reduced and the manufacturing cost decreases.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A pedal apparatus for a vehicle, comprising:

a pedal arm mounted on a vehicle body by a hinge shaft and having a first end connected with a pedal and a second end where a rack gear is formed, with respect to the hinge shaft;

a link arm having a pinion gear at one end which meshes with the rack gear to pivot on a center shaft of the pinion gear during pivoting of the pedal arm, and having another end where a locking pin is formed; and a plate mounted on the vehicle body and being formed with a sliding groove, such that the locking pin of the link arm is inserted and slides in the sliding groove, wherein ridges and depressions are formed at intervals in the sliding groove so that the locking pin slides in a step-by-step manner while being locked to the ridges and depressions.

2. The apparatus of claim 1, wherein the second end of the pedal arm having the rack gear is comprised of an extension link extending upward above the hinge shaft.

3. The apparatus of claim 2, wherein the rack gear at the end of the extension link is formed with a plurality of teeth facing downwardly.

4. The apparatus of claim 3, wherein a guide slot having a predetermined length is formed through the extension link in parallel with the teeth of the rack gear, at a predetermined position under the rack gear and the pinion gear meshes with the rack gear, with the center shaft fixed to the vehicle body through the guide slot under the rack gear.

5. The apparatus of claim 3, wherein the plate is disposed at a predetermined position under the rack gear, and the link arm has the one end disposed upwardly so that the pinion gear engages with the rack gear and the other end disposed downwardly so that the locking pin is inserted in the sliding groove.

6. The apparatus of claim 1, wherein a guide slot having a predetermined length is formed at a predetermined position between the rack gear of the pedal arm and the hinge shaft, and the center shaft of the pinion gear is fixed to the vehicle body through the guide slot.

7. The apparatus of claim 1, wherein the pinion gear is fixed to the one end of the link arm, the center shaft of the pinion gear is fixed to the vehicle body, such that rotation of the pinion gear causes the link arm to rotate.

8. The apparatus of claim 1, wherein the sliding groove of the plate is formed in an arc shape, coaxially about the center shaft of the pinion gear.

9. The apparatus of claim 1, wherein the sliding groove of the plate is longer than a length of the rack gear.

10. The apparatus of claim 1, wherein the ridges and depressions of the sliding groove are formed by a plurality of continuous locking grooves, and the locking pin of the link arm is inserted into and locked in the locking grooves.

* * * * *